United States Patent [19]

Falk

[11] 4,122,324

[45] Oct. 24, 1978

[54] SHIELDING DEVICE FOR MICROWAVE COOKING

[75] Inventor: Stephen A. Falk, Sherborn, Mass.

[73] Assignee: Teckton, Inc., Wellesley, Mass.

[21] Appl. No.: 757,076

[22] Filed: Jan. 5, 1977

[51] Int. Cl.[2] ..... H05B 9/00

[52] U.S. Cl. ..... 219/10.55 E; 426/237; 426/241

[58] Field of Search ..... 219/10.55 E; 426/243, 426/233, 234, 240, 241-242, 236; 99/446, 444; 229/14 BL, 14 H

[56] References Cited

U.S. PATENT DOCUMENTS

| | | | |
|---|---|---|---|
| 2,322,345 | 6/1943 | Cage | 229/14 BL |
| 2,658,662 | 11/1953 | Paulsen | 229/14 BL |
| 2,695,744 | 11/1954 | Gattuso | 229/14 H |
| 3,127,828 | 4/1964 | Fine | 99/446 |
| 3,271,169 | 9/1966 | Baker et al. | 219/10.55 E |
| 3,547,661 | 12/1970 | Stevenson | 426/243 |
| 4,013,798 | 3/1977 | Goltos | 219/10.55 E |
| 4,015,085 | 3/1977 | Woods | 219/10.55 E |

*Primary Examiner*—C. L. Albritton
*Assistant Examiner*—Bernard Roskoski
*Attorney, Agent, or Firm*—Wolf, Greenfield & Sacks

[57] ABSTRACT

A disposable microwave shielding device for use in connection with controlled microwave heating of foods is formed from a dielectric sheet which is covered, on one surface, with a conductive sheet or film. The other surface of the sheet is covered or coated with a sheet or film of high temperature, burn-resistant material. The laminate or sandwich effectively precludes combustion of the dielectric sheet which might otherwise occur during heating by isolating the dielectric material from the air.

3 Claims, 3 Drawing Figures

SHIELDING DEVICE FOR MICROWAVE COOKING

BACKGROUND AND SUMMARY OF THE INVENTION

This invention relates to improvements in containers used in the microwave heating of foods and, particularly, containers of the type having a conductive shield laminated or otherwise applied to the surface of the container to control the exposure of the packaged food to microwave energy and thus control the heating process. More particularly, the present invention relates to such a package in which the shield is formed from a combustible material such as paper, or a thermoplastic material which might melt under the influence of high temperature.

Typically, the food product is packaged in a dielectric tray which, in turn, may be inserted into an outer package which has a conductive shielding imprinted on or otherwise applied to the package. The conductive shielding is of a configuration to define radiation transparent apertures which are of a size and configuration dependent on the nature, size and shape of the food product in the tray. The outer package is provided on one surface (usually its outer surface) with the conductive shielding film. This can present some difficulties and danger, particularly when the outer package is formed primarily of a combustible material such as thin cardboard, paper or the like. The danger of fire results from the fact that slight imperfections in the shielding film may, sometimes, cause arcing. Although the arcing usually is of a short duration, the temperatures generated in the region of the arc far exceed the flash point of the combustible container. That may cause the cardboard or paper to ignite. Arcing is not uncommon and can result in a number of instances, for example, by a scratch mark or even a small pinpoint in the shielding film. Other irregularities in the shape or edges of the shielding material can have the same effect because such irregularities tend to concentrate the strength of the microwave field in those regions.

In accordance with the present invention, the sheet material from which the outer package is formed is coated or laminated on both surfaces of the sheet so that no significant portions of the combustible sheet will be exposed to the oxygen in the air. Thus, even if some arcing may occur, there is insufficient exposure of the sheet to the oxygen and combustion will not be supported. In the preferred embodiment of the invention, both sides of the dielectric sheet are coated with a metallic film which serves both to shield the food as well as dissipate rapidly heat generated by such arcing.

It is among the general objects of the invention to provide an improved shielding container for use in microwave heating.

Another object of the invention is to provide a microwave shielding container which has improved safety features and which will minimize any tendency for the container to burn as a result of arcing.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENTS

Figure 1:
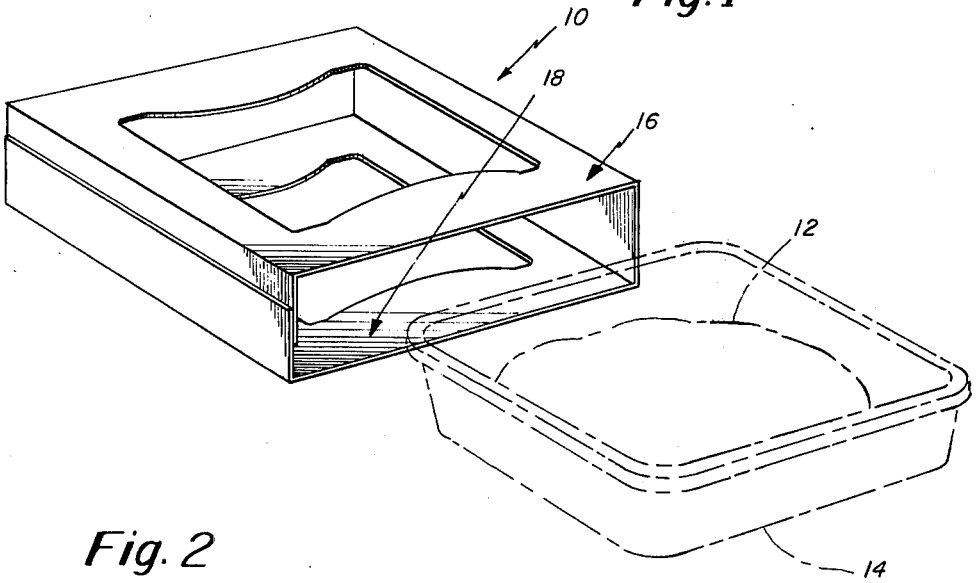
FIG. 1 is an illustration of a shielding package of the type in which the invention is incorporated and showing, in phantom, a food bearing tray receivable in the outer package.
Figure 2:
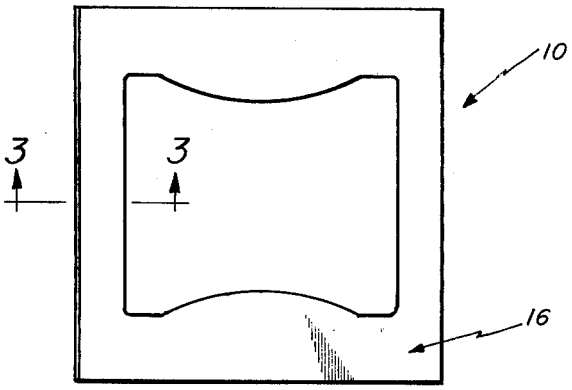
FIG. 2 is a plan view of the package shown in FIG. 1.
Figure 3:
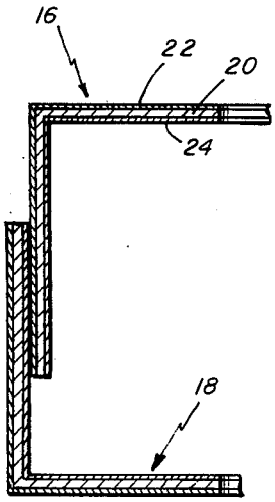
FIG. 3 is an enlarged sectional elevation of a portion of the container as seen along the line 3—3 of FIG. 2.

FIGS. 1–3 illustrate a typical type of shielding package, indicated generally by the reference character 10, which might be used to package a convenience food intended to be heated or cooked in a microwave oven. The food, suggested in phantom at 12, typically will be packaged in a tray 14 or other appropriate internal container transparent to microwave energy. The tray 14 may be made from paper, plastic or the like. The tray 14, filled with the food product 12, is inserted into the outer shielding package 10 by any of a variety of packaging techniques. In the embodiment shown in FIGS. 1 and 2, the outer package 10 is shown in the form of a sleeve, for purposes of illustration only.

The outer package is formed primarily from a dielectric material and paperboard or like cardboard usually is the preferred material. In some instances, a thermoplastic material might be employed as the primary structural material for the outer shielding package. In the embodiment shown, apertures are formed in each of the top and bottom walls 16, 18 of the shield 10. The shape and size of the apertures will be selected to suit the size, shape and nature of the food product in the tray 14, the somewhat hourglass shape shown being solely for purposes of illustration. In order to shield the food product 12, one of the outer or inner surfaces of the sheet material from which the package 10 is made is coated or laminated with a thin film of conductive material, such as a thin film of aluminum or other metal which can be applied in accordance with a variety of well-known processes. While that is sufficient to effect the controlled shielding of the food product 12, the fact that very substantial portion of the surface of the dielectric sheet still is exposed to the atmosphere, results in the possibility that if arcing occurs, that may cause the paperboard to ignite. Because very substantial areas of the paperboard are exposed to the air, the package 10 may begin and continue to burn. In this regard, it should be noted that the arcing usually is for a very brief interval. The temperatures generated in the plasma at the arc, however, are very high and can reach a few thousand degrees Farenheiht. Thus, although the duration of the arc typically is very brief, a temperature is reached which can ignite the paper.

In accordance with the invention, the primary structural sheet 20 is coated or covered with a metallic shielding film 22 fully on one of its surfaces (the outer surface in the illustration). For simplification in manufacture, the blank from which the package 10 is made should be precoated in its entirety with the metallic film 22. The opposite, inner surface of the dielectric sheet 20 also is coated fully along its surface with a film which will isolate the inner surface of the sheet 20 from the oxygen in the atmosphere. The inner film 24 may be identical to the metallic shielding film 22. That is preferred because of the heat conductive capability of the metallic film, as distinguished from the other types of coatings. By employing metallic films 22, 24 both on the inner and outer surfaces of the sheet 20, the heat of the arc is dissipated very rapidly. This also tends to reduce the tendency for the interal sheet 20 to become charred. Also, if the internal sheet 20 is formed from a thermoplastic material, the rapid dissipation of heat through the heat conductive films 22, 24 reduces any tendency for the thermoplastic sheet to melt.

It should be noted that although a metallic film is preferred on both the inner and outer surfaces of the sheet 20, it is only essential for shielding purposes that one of the surfaces be coated with a metallic film. The opposite surface may be coated with non-metallic films such as, for example, high temperature, heat resistant polyamides. When the metallic film is formed only on one surface of the package, it may be preferable for the package to be formed so that the shield is on the inner surface as that may reduce the chances of the metallic film being scratched.

It may be noted that the cut edges of the sheet from which the outer package 10 is made are not coated. Although these edges will be exposed to the atmosphere, their area of exposure is so small that, even if arcing did occur in that region, the edges of the sheet 20 would at most become slightly charred but would not begin to burn.

By way of example, a package of the type shown may be made from paper board having a thickness of the order of ten mils. The films 22, 24 may be of the order of one third of a mil in thickness.

It should be understood that the foregoing description of the invention is intended merely to be illustrative thereof and that other embodiments and modifications of the invention may be apparent to those skilled in the art without departing from its spirit.

Having thus described the invention, what I desire to claim and secure by Letters Patent is:

1. A shielding package for use in the controlled heating of foods by microwave energy comprising:

a container formed from a dielectric sheet of material, said container having inner and outer surfaces;

one of said inner or outer surfaces being provided with a film of conductive material, opaque to microwave energy, said film covering the full area of said surface;

the other of said surfaces being coated with a heat-resistant, high temperature film over its entire surface;

said container having, in its assembled state, at least one aperture formed therein to selectively control the extent of microwave energy which passes into the container.

2. A shielding package as defined in claim 1 wherein said high temperature, heat resistant film is electrically and thermally conductive.

3. A shielding package as defined in claim 1 wherein the inner surface of the container is provided with said film of conductive material and wherein the outer surface is coated with a non-conductive material.

* * * * *